US005987680A

United States Patent [19]

Sakaya

[11] Patent Number: 5,987,680

[45] Date of Patent: Nov. 23, 1999

[54] BRIDGE DECK UNIT AND PROCESS FOR CONSTRUCTION BRIDGE DECK USING THE UNIT

[75] Inventor: Yoshinori Sakaya, Fuji, Japan

[73] Assignee: Kazumi Kazaoka, Shimizu, Japan

[21] Appl. No.: 09/161,918

[22] Filed: Sep. 29, 1998

[30] Foreign Application Priority Data

May 25, 1998 [JP] Japan ..... 10-142735

[51] Int. Cl.[6] ..... E01D 19/12

[52] U.S. Cl. ..... 14/73; 14/77.1; 404/70

[58] Field of Search ..... 14/73–77.1; 404/70, 404/134, 135, 136

[56] References Cited

FOREIGN PATENT DOCUMENTS 8-113917 5/1996 Japan .

*Primary Examiner*—Thomas B. Will
*Assistant Examiner*—Kristine M. Markovich
*Attorney, Agent, or Firm*—Oliff & Berridge, PLC

[57] ABSTRACT

A bridge deck unit and a process for constructing a bridge deck using the unit, wherein deviation and deflection of reinforcements are prevented, and problems of complicated operation and high cost are solved. Connecting plates for connecting portions of main reinforcements are disposed at a predetermined distance from each other in a longitudinal direction of the main reinforcements such that upper and lower ends of the connecting plates are respectively secured to side surfaces of the main reinforcements.

19 Claims, 5 Drawing Sheets

(A)

(B)

BRIDGE DECK UNIT AND PROCESS FOR CONSTRUCTION BRIDGE DECK USING THE UNIT

BACKGROUND OF THE INVENTION

1. Field of the Invention

The present invention relates to a transportable bridge deck unit in which a framework and reinforcements for forming a deck are previously assembled, for constructing the deck on bridge girders of a road bridge, railway bridge, or other bridges constructed across river or sea, or on land.

2. Related Art

A deck made of reinforced concrete which is often used for a bridge such as a road bridge is basically produced by mounting a reinforcement assembly formed by assembling necessary reinforcements such as main reinforcements, distributing bars, and the like inside a framework, and depositing concrete within the framework.

Conventionally, a framework member is made of plywood and all operational step, from assembly of the framework to construction are carried out on the bridge girders. The operations in such an environment is not only very dangerous, but also inefficient, affected by weather, and consuming wood resources in large quantities.

Also, it is laborious for workers to regularly dispose the main and distributing bar at predetermined spatial positions, to constantly dispose the reinforcements in a state in which the main reinforcements and the like are lifted with a space from a reference surface by a constant distance, and to keep the whole shape of the reinforcements in a grille configuration, on a construction site.

Furthermore, the reinforcements are assembled by welding them or tying them with wire.

In a case of using a welding method, a defective area may be generated in both of the reinforcements to be tied together.

In a case of tying the reinforcements with wire, on the other hand, such operation is manually carried out on the construction site and thus, the positions to which the reinforcements should be arranged are easily deviated.

In addition, in order to obtain further unit earthquake resistance, sufficient coupling strength between the reinforcements can not be obtained by coupling same using welding method or wiring method, and such welding or fastening with were are inefficient.

Consequently, some constructors use a prefabricated deck in which the entire deck or a portion thereof is fabricated in a plant.

However, any producing process of the prefabricated deck is complicated in structure, and the structure is not rational because it requires extra support members and too many main members.

The prefabricated deck is accompanied by various problems regarding construction on the construction site, and cost required for construction of the prefabricated deck is higher as compared with the conventional deck.

Therefore, in order to solve the various problems accompanying the above-described deck constructed on the construction site or a prefabricated deck, a process for constructing a new type of prefabricated deck, which is a compromise process between the process for constructing the deck on the construction site and the process for prefabricating the deck, is disclosed in the Japanese Unexamined Patent Publication (KOKAI)No. 8-113917.

In that, framework to be used for a concrete framework is first formed and then a deck assembly is formed by fixing main reinforcements in a framework which will serve as a bottom plate of the deck unit for a long time, and it is transferred to the construction site and concrete is deposited into the framework.

However, because the main reinforcements are conventionally maintained in the framework using wire or grasping means in the above-described new type of process for constructing the prefabricated deck, fastened portions wire are liable to become loose at the time of transfer, for example, thereby allowing the reinforcements to move.

In the case of using the grasping means, a portion caulked by a hook of the grasping means, which is generally called a shear gripping met liable to loose and because the grasping means (a shear gripping method) per se, requires a folded portion to form the hooked portion reducing the means to support heavy weight and thus the reinforcements are deflected by load due to the considerable weight of the grasping means thereby degrading the strength, durability, and earthquake resistance of the framework.

SUMMARY OF THE INVENTION

It is an object of the present invention to provide a bridge deck unit and a process for constructing a bridge deck using the unit, wherein the above defects of the prior art are overcome, taking advantage of the above new type of prefabricated deck while preventing deviation and deflection of the reinforcements thereof, and solving the problems of complicated operations and high cost.

In order to achieve the above-mentioned object, the present invention basically employs the following technical structure.

According to a first embodiment of the present invention, there is proposed a bridge deck unit comprising, a framework having a bottom portion, a group of main reinforcements disposed in parallel to one another in side by side configuration, at predetermined distance from one another, each of said main reinforcements comprising at least two sub-reinforcements disposed substantially in parallel to each other at a predetermined distance from each other in a vertical direction, and connecting plates each having a predetermined width for connecting each portions of side surfaces of said two sub-reinforcements consisting each of said main reinforcements, respectively, wherein said connecting plates a disposed at a predetermined distance from one another in a longitudinal direction of each of said main reinforcements such that upper and lower ends of said connecting plates are respectively secured to each one of said side surfaces of said two sub-reinforcements.

According to a second embodiment of the present invention, there is proposed a process for constructing a bridge deck including the steps of mounting a bridge deck unit on an upper portion of a bridge girder of a bridge to be constructed, inserting a distributing bar in a direction intersecting at right angles with a longitudinal direction of said main reinforcement in said main reinforcement group and fixing said distributing bar at a necessary position of said main reinforcement group, and depositing concrete into said framework.

DESCRIPTION OF THE PREFERRED EMBODIMENT

The bridge deck unit and the process for constructing the bridge deck using the unit have above-described structure, and are characterized in that the connecting plate having a predetermined width for connecting portions of side surfaces of the at least two sub-reinforcements of each of the main reinforcements are disposed at a predetermined distance from one another in the longitudinal direction of the main reinforcements, such that upper and lower ends of the connecting plates are respectively secured to the side surfaces of the two sub-reinforcements, thereby preventing deviation of the main reinforcements and looseness of the connecting plates, and deflection of the at least two sub-reinforcements can be effectively prevented through the connecting plates throughout the entire length of the main reinforcement.

Specific embodiments of a bridge deck unit and a process for constructing a bridge deck using the unit of the present invention will be described below, with reference to the drawings.

Figure 1:
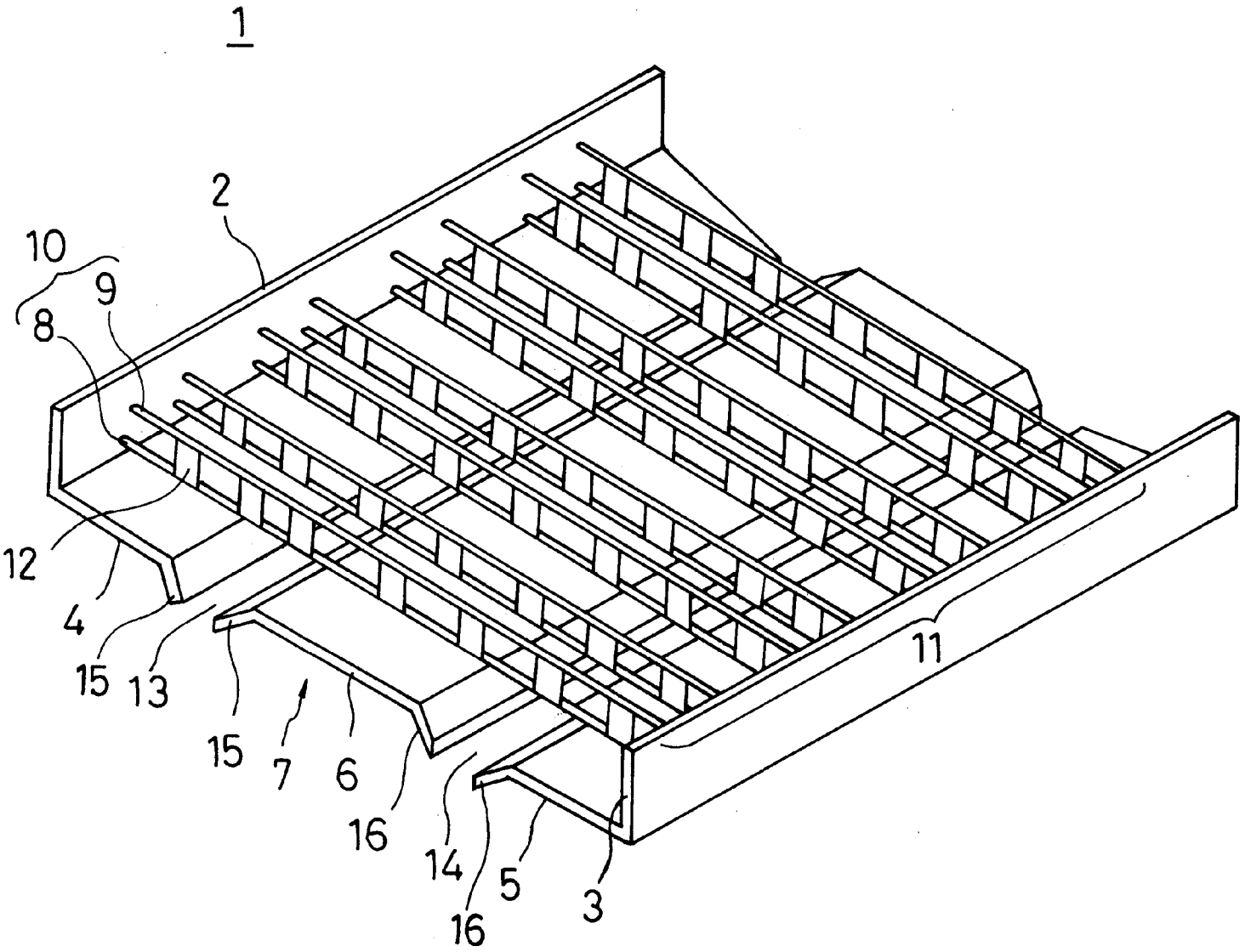
FIG. 1 s a perspective view of a bridge deck unit of the present invention.

FIG. 1 is perspective view showing a structure of an embodiment of the bridge deck unit of the invention.

FIG. 1 shows a bridge deck unit 1 comprising a framework 7 divided into three portions, i.e., side portions 4 and 5 whose outer ends are turned upwardly to form side boards 2 and 3, respectively, and an intermediate portion 6 disposed between the side portions 4 and 5.

The bridge deck unit 1 further comprises, within the framework 7, a main reinforcement group 11 including main reinforcements 10 disposed in parallel in side by side configuration at a predetermined distance from one another. Each the main reinforcement 10 comprises two sub-reinforcements 8 and 9 disposed substantially in parallel and vertically spaced apart from each other by a predetermined distance.

The bridge deck unit 1 further comprises connecting plates 12 each having a predetermined width for connecting portions of side surfaces of the two sub-reinforcements 8 and 9 forming the main reinforcement 10.

The connecting plates 12 are disposed at a predetermined distance from one another in longitudinal direction of the main reinforcement 10, and are secured to the side surfaces of the two sub-reinforcements 8 and 9 at the upper and lower end portions of the connecting plates 12, respectively.

A number of the sub-reinforcements constituting the main reinforcement 10 and a number of the main reinforcements 10 disposed to form the main reinforcement group 11 are appropriately determined in light of a shape of the deck which includes the framework 7 serving as a base portion or load applied thereto.

A number of the connecting plates 12 disposed in the longitudinal direction of the in reinforcement 10 are also appropriately determined in light of length of the main reinforcement 10, a distance between the sub-reinforcements 8 and 9, and the like, but it is desirable that the connecting plates 12 are disposed at substantially constant intervals in the direction of and throughout the length of the main reinforcement 10.

The connecting plates 12 may be made of wood or plastic, but are preferably made of weldable metal for preventing their damage at the time of construction of the deck and for their strength developing thereafter. Also, it is preferable the at the connecting plates 12 are secured to the two sub-reinforcements 8 and 9 by welding.

The connecting plates 12 may be in a simple rectangular shape, and weight thereof can be reduced, if the connecting plates 12 are minimized in size by setting a length formed between a pair of opposite sides of the connecting plate in vertical direction, at substantially the same value as a distant between axis cores of the two sub-reinforcements 8 and 9.

Figure 2:
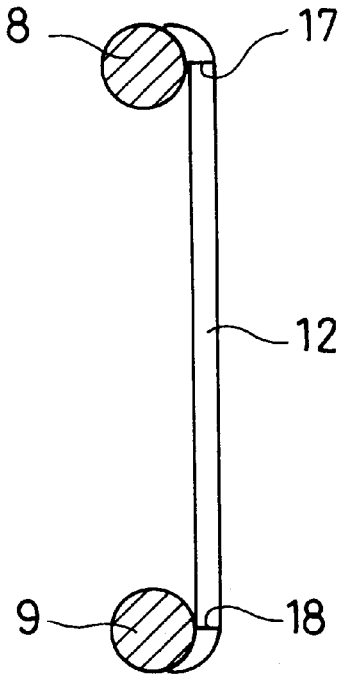
FIG. 2 is a side view showing a state in which a main reinforcement and a connecting plate of the invention are secured to each other.
Figure 3:
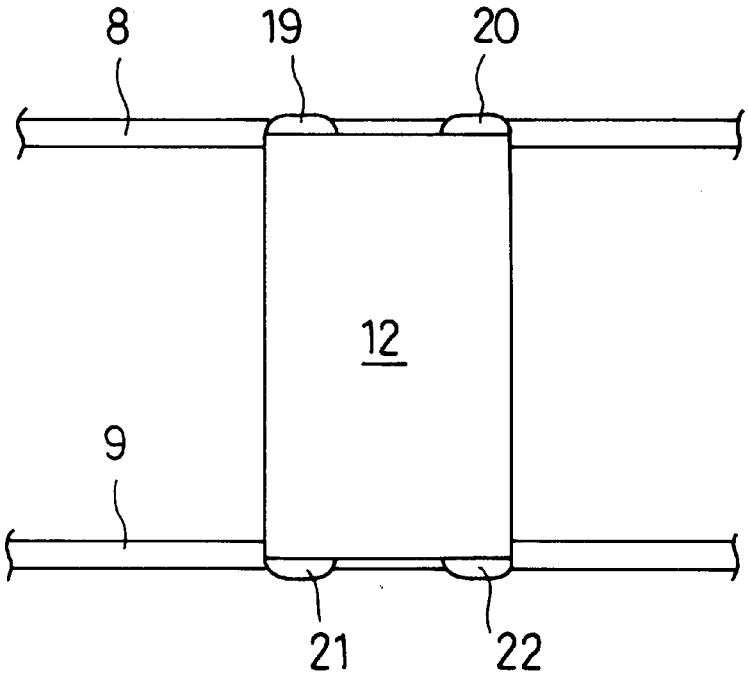
FIG. 3 is a front view showing a state in which the main reinforcement and the connecting plate of the invention are secured to each other.

When the connecting plate in the above shape is welded to the two sub-reinforcements 8 nd 9, it is preferable that welding portions 19, 20, 21, and 22 are formed by spot welding at opposite end portions of a pair of opposite sides 17 and 18 of the rectangular connecting plate 12, so that the welding portions form a slab structure with each other, as shown in a sectional view in FIG. 2 and a front view in FIG. 3.

It generally holds true of welding operations that the welding portions are also preferably formed by tap welding to make up for defective areas caused by welding.

Size of the rectangular connecting plates can be determined in light of diameter of the main reinforcement 10, a distance between the reinforcements, and so on, but it is preferable that the width of the connecting plate 12 is 105 mm or less, if diameter of the reinforcements forming the main reinforcement is 19 mm, disposition pitch of the connecting plates is 250 mm, and diameter of a distributing bar disposed later between the connecting plates 12 to intersect with longitudinal direction of the main reinforcement 10 is 16 mm, for example.

According to the present invention, even if the width of the connecting plate is set at 7 mm, effect of preventing deflection of the main reinforcement can be improved, as compared with the case in which the above conventional grasping means is employed.

The main reinforcement 10 may be fixed by assembling other self-sustaining reinforcements for mounting the main reinforcement 10 on the side portions 4 and 5 of the framework 7.

Figure 4:
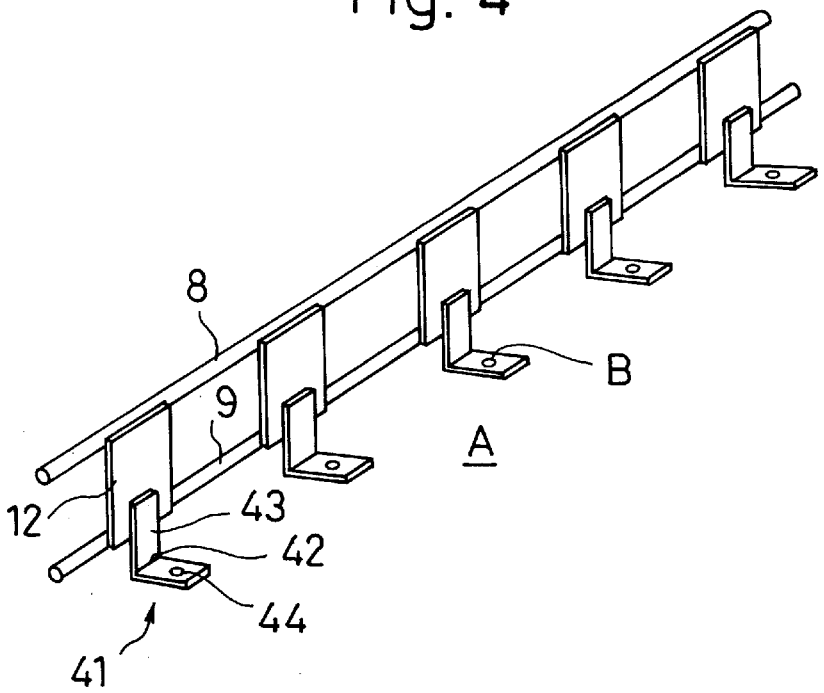
FIG. 4 is a perspective view showing a state in which connecting plates using fixing members of the invention are fixed to a bottom portion of a framework.
Figure 5:
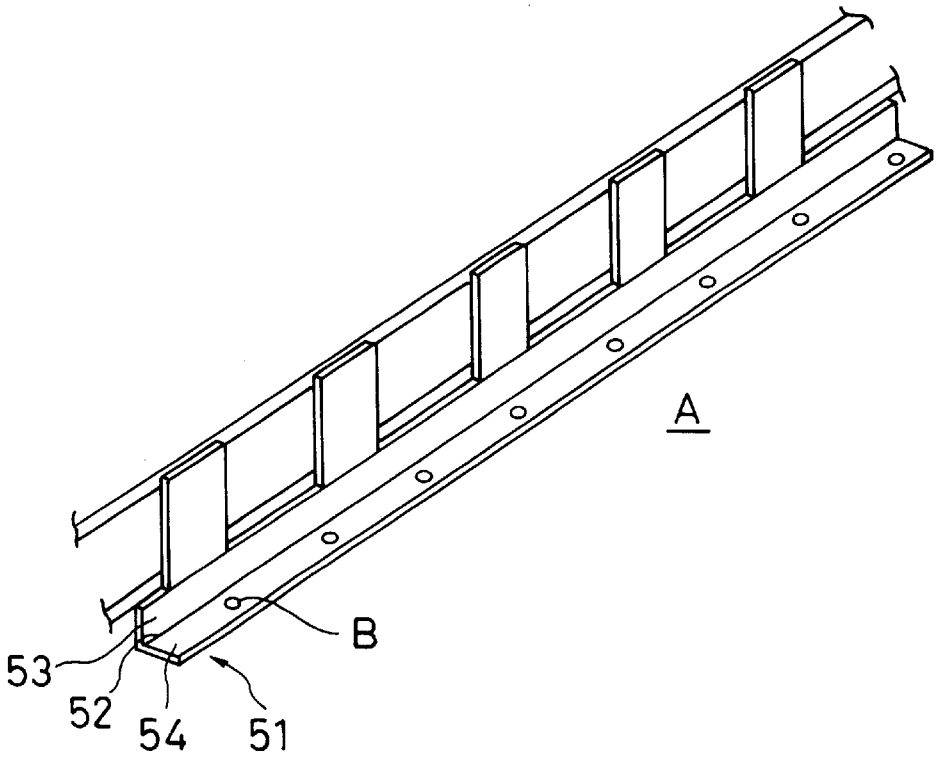
FIG. 5 is a perspective view showing a state in which the connecting plates using a fixing member of the invention are fixed to the bottom portion of the framework.

However, it is preferable to fix the connecting plates to a bottom portion of the framework 7 by using fixing members as illustrated in FIGS. 4 and 5, for example, so that the main reinforcement 10 to which the connecting plates 12 and the fixing members are previously secured can be integrally fixed to a predetermine position of the bottom portion of the framework 7, thereby improving operational efficiency.

The fixing members may be ones shown in FIGS. 4 and 5, for example, each having a bent portion and flat portions of opposite sides of the bent portion, the flat portions being respectively bonded to the connecting plate 12 and the bottom portion of the framework 7.

In other words, a plate piece 41 shown in FIG. 4 has a smaller width in the longitudinal direction of the main reinforcement than that of the connecting plate 12, and has flat portions 43 and 44 of the opposite sides of a bent portion 42 which are respectively bonded to the connecting plate 12 and the bottom A of the framework 7.

A plate piece 51 shown in FIG. 5 has a width covering all the connecting plates disposed long and throughout the length of the main reinforcement 10, and has flat portion 53 and 54 of opposite sides of a bent portion 52 respectively bonded to the connecting plates 12 and the bottom portion A of the framework 7.

The bent plates 41 and 51 may be bonded to the connecting plates 12 by welding. The plates 41 and 51 are preferably bonded to the bottom portion A of the framework 7 by bolts or rivets B to prevent time-elapsing sequence-degradation of the bonded portion caused in a case in that the plates are welded to the bottom portion A.

The frame work 7 is preferably provided with opening portions 13 and 14 for receiving the bridge girders between the side portion 4 and the intermediate portion 6 and between the side portion 5 and the intermediate portion 6 of the framework 7, respectively, in order to couple the deposited concrete and the bridge girder, when the bridge deck unit 1 is mounted on the bridge girder of the bridge to be constructed.

Also, it is desirable that the framework 7 can be adjusted in height relative to the bridge girders by the fact that end flaps that define the opening portions 13 and 14 can be bent relative to a flat face portion of a main portion of the bridge girders.

For this purpose, flap-shaped bent portions 15 and 16 are provided to opposite ends of the opening portions 13, 14 in the illustrated example.

Furthermore, it is desirable that means for adjusting height from the bridge girders is provided on the connecting plates 12 which are disposed in the vicinity of the opening portions 13 and 14.

Figure 6:
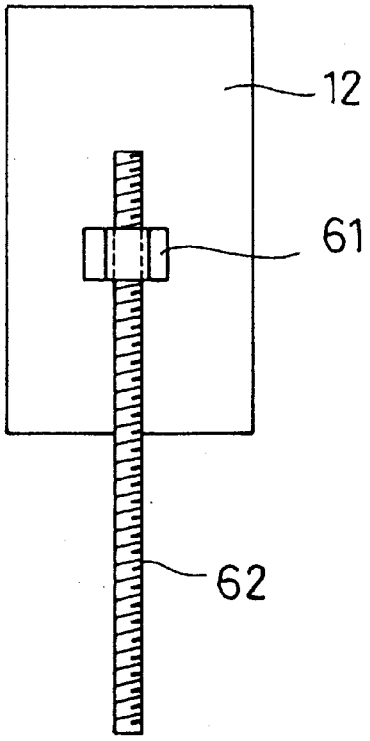
FIG. 6 is a perspective view showing a state of a height adjusting means of the invention.
Figure 6:
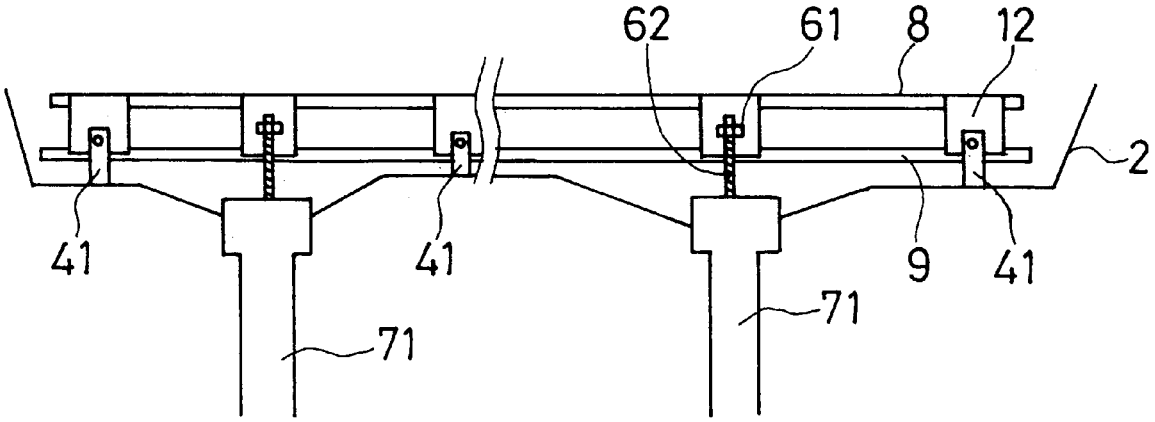

The height adjusting means may be one comprising an internal thread member 61 such as a nut fixed to the connecting plate 12 and an external thread member 62 such as a bolt fitted into the internal thread member 61, as shown in FIG. 6(A), for example, and the connecting plate 12, or the deck unit 1 can be adjusted in height by moving up and down the external thread member 62 relative to the internal thread member 61, in a state in which a lower end of the external thread member 62 abuts on the flat face of the main portion of the bridge girder.

FIG. 6(B) shows one specific embodiment of the present invention in that the height adjusting means comprising a portion 61 and a portion 62 is used on a top surface of the bridge pier.

Figure 7:
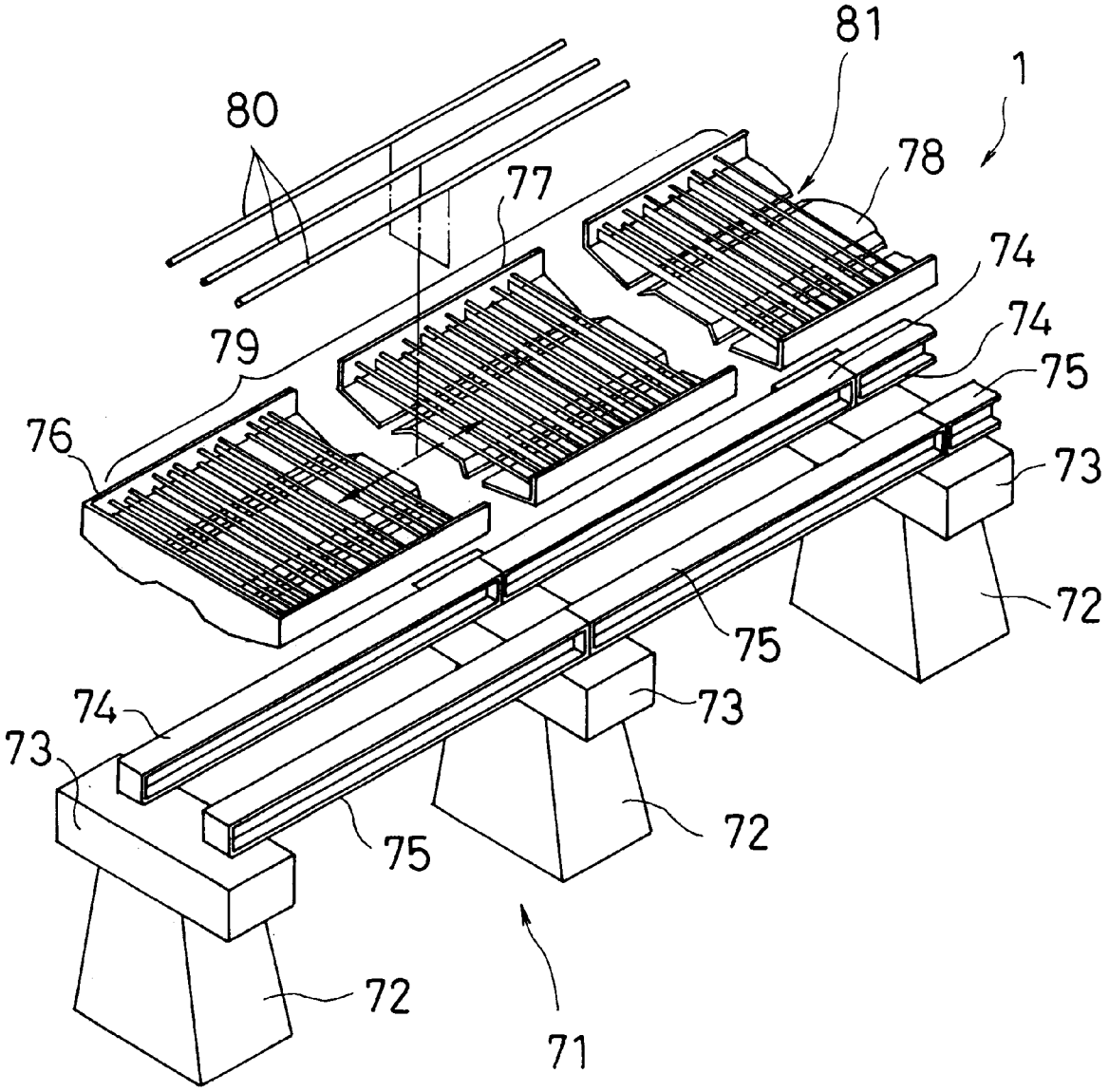
FIG. 7 is a perspective view showing a state of a process for constructing a deck of the invention.

Next, a process for constructing the bridge deck using the bridge deck unit 1 will be described. As shown in FIG. 7, a bridge 71 includes a plurality of bridge piers 72 and bridge abutments 73, and two or more lines of bridge girders 74 and 75 are successively disposed between the adjacent bridge piers. Each of the bride girders 74 and 75 is fixed to the bridge piers 72 by bolts for preventing its deviation in a lateral direction.

After the plurality of bridge deck units 76, 77, and 78 are mounted on the bridge girders 74 and 75, distributing bars 80 are inserted in a direction intersecting at right angles with a longitudinal direction of the main reinforcement 79 in a group of the main reinforcements 79. The distributing bars 80 are fixed to the main reinforcement group 79 by wire, for example.

Then, concrete is deposited into the frameworks 76, 77, and 78. At the time of depositing concrete, it is preferable that joints between opening portions 81 provided at the bottom portions of the frameworks 76, 77, and 78 and the bridge girder 74 and 75 and/or joints between the units 76, 77 and 78 are sealed by putting seats made of cloth, plastic, metal, adhesive tapes, and the like on the joints or by forming a seal by foam sealant, and the like, before depositing of concrete.

Because the bridge deck unit and the process for constructing the bridge deck using the unit according to the present invention employs the above-described structure, the unit previously formed by assembling the reinforcements in the framework can be transferred to the bridge construction site to construct the deck.

Also, because the connecting plates for connecting the main reinforcements are secured to the main reinforcements, it is possible to prevent deviation or deflection of the main reinforcements due to looseness of the connected portions of the reinforcements, and to solve problems of complicated operations and high cost.

The connecting plate made of a steel plate having thickness of 2.3 mm has a width of 8 cm and a length of 17 cm, for example, and can be smaller in size as compared with the conventional grasping means made of the same steel plate having thickness of 2.3 mm, which has a width of 10 cm and a length of 35 cm. The above connecting plate is 4 Kg and lightweight as compared with the conventional grasping means which is 10 Kg.

Therefore, the above connecting plate hardly causes deflection of the reinforcements an can increase the degree of freedom of designing the deck.

What is claimed is:

1. A bridge deck unit, comprising:

a framework having a bottom portion;

a group of main reinforcements disposed in parallel to one another in side by side configuration in said framework and arranged perpendicular to a longitudinal axis of said framework and parallel to a main surface of said framework, at a predetermined distance from one another, each of said main reinforcements comprising at least two sub-reinforcements disposed substantially in parallel to each other at a predetermined distance from each other in a vertical direction; and connecting plates each having a predetermined width for connecting each portions of side surfaces of said two sub-reinforcements consisting each of said main reinforcements, respectively;

wherein said connecting plates are disposed at a predetermined distance from one another in a longitudinal direction of each of said main reinforcements such that upper and lower ends of said connecting plates are respectively secured to each one of said side surfaces of said two sub-reinforcements.

2. A bridge deck unit according to claim 1, wherein said connecting plates are made of weldable metal and are secured by welding to the side surfaces of said at least two sub-reinforcements forming each of said main reinforcements at upper and lower end portions of each one of said connecting plates, respectively.

3. A bridge deck unit according to claim 2, wherein said connecting plates are rectangular, a distance between a pair of opposed sides of said rectangular connecting plates is substantially equal to a distance formed between a longitudinal axis of said at least two sub-reinforcements forming said main reinforcement, and said pair of opposed sides of said rectangular connecting plates are secured to said at least two sub-reinforcements by welding, respectively.

4. A bridge deck unit according to claim 3, wherein opposite end portions formed on each one of said pair of opposite sides of said rectangular connecting plate are spot-welded to said at least two sub-reinforcements forming said main reinforcement, respectively.

5. A bridge deck unit according to claim 2, wherein opposite end portions formed on each one of said pair of opposite sides of said rectangular connecting plates are tap-welded to the at least two sub-reinforcements forming said main reinforcement.

6. A bridge deck unit according to claim 1, wherein a width of said connecting plate is in a range of 70 to 105 mm.

7. A bridge deck unit according to claim 1, further comprising a fixing member for fixing said connecting plates to the bottom portion of said framework.

8. A bridge deck unit according to claim 7, wherein said fixing member is a plate piece having a bent portion, and flat portions formed at both sides of said bent portion are bonded to said connecting plate and the bottom portion of said framework, respectively.

9. A bridge deck unit according to claim 8, wherein one of said flat portions is bonded to the bottom portion of said framework using a bolt or rivet.

10. A bridge deck unit according to claim 8, wherein a width of said plate piece having the bent portion in a longitudinal direction of said main reinforcement is smaller than the width of said connecting plates in the longitudinal direction of said main reinforcement.

11. A bridge deck unit according to claim 8, wherein a single said plate piece having a width covering approximately overall length of the connecting plate disposed long and throughout length of the main reinforcement, is connected to each one of said connecting plates.

12. A bridge deck unit according to claim 1, wherein said bottom portion of the framework is provided with opening portions for receiving a bridge girder of a bridge to be constructed.

13. A bridge deck unit according to claim 12, wherein a part of each of said opening portions can be flexibly bent relative to a flat surface of a main portion of said bridge girder.

14. A bridge deck unit according to claim 12, wherein a means for adjusting height formed between said deck unit and said bridge girder, is provided to said connecting plate disposed in the vicinity of said opening portion.

15. A bridge deck unit according to claim 14, wherein said height adjusting means includes internal thread member fixed to said connecting plate and an external thread member fitted in said internal thread member, and said connecting plate disposed in the vicinity of said opening portion is adjusted in height from said bridge girder by moving up or down said external thread member relative to said internal thread member.

16. A process for constructing a bridge deck comprising the steps of:

mounting a bridge deck unit on an upper portion of a bridge girder of a bridge to be constructed, said bridge deck unit comprising a framework having a bottom portion, a group of main reinforcements disposed in parallel to one another in side by side configuration in said framework and arranged perpendicular to a longitudinal axis of said framework and parallel to a main surface of said framework at a predetermined distance from one another, each of said main reinforcements comprising at least two sub-reinforcements disposed substantially in parallel to each other at a predetermined distance from each other in a vertical direction, and connecting plates each having a predetermined width for connecting each portions of side surfaces of said two sub-reinforcements consisting each of said main reinforcements, respectively, said connecting plates being disposed at a predetermined distance from one another in a longitudinal direction of each of said main reinforcements such that upper and lower ends of said connecting plates are respectively secured to each one of the side surfaces of said two sub-reinforcements;

inserting a distributing bar in a direction intersecting at right angles with a longitudinal direction of said main reinforcement in said main reinforcement group and fixing said distributing bar at a necessary position of said main reinforcement group; and depositing concrete into said framework.

17. A process for constructing a bridge deck according to claim 16, wherein said bottom portion of the framework is provided with an opening portion, sections provider in the vicinity of which, can be bent relative to a flat face of a main portion of said bridge girder, for receiving the bridge girder of the bridge to be constructed, and a means for adjusting height from said bridge girder is provided to said connecting plate disposed in the vicinity of said opening portion, and concrete is deposited into said framework after adjusting said bottom portion of the framework in height from said bridge girder.

18. A process for constructing a bridge deck according to claim 16, wherein concrete is deposited after sealing a joint formed between said opening portion of the framework and said bridge girder.

19. A process for constructing a bridge deck according to claim 16, wherein concrete is deposited into said framework after disposing two or more of said units on said bridge girder and sealing a joint between said units.

* * * * *